US008025519B2

(12) United States Patent
Handshaw et al.

(10) Patent No.: US 8,025,519 B2
(45) Date of Patent: Sep. 27, 2011

(54) ELECTRO-OPTICAL READER WITH CABLE CONNECTOR RELEASE

(75) Inventors: Darran Handshaw, Sound Beach, NY (US); Bruce Rowell, Lake Grove, NY (US); Timothy Kehoe, Smithtown, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 107 days.

(21) Appl. No.: 12/617,011

(22) Filed: Nov. 12, 2009

(65) Prior Publication Data

US 2011/0111617 A1 May 12, 2011

(51) Int. Cl.
*H01R 13/627* (2006.01)

(52) U.S. Cl. ..... 439/352

(58) Field of Classification Search ..... 439/352, 439/542, 354, 372, 266; 385/59, 55, 56, 385/76

See application file for complete search history.

(56) References Cited

U.S. PATENT DOCUMENTS

| | | | | |
|---|---|---|---|---|
| 3,860,316 | A | 1/1975 | Hardesty | |
| 5,558,533 | A * | 9/1996 | Hashizawa et al. | 439/310 |
| 5,579,425 | A * | 11/1996 | Lampert et al. | 385/59 |
| 7,326,075 | B1 * | 2/2008 | Armstrong et al. | 439/354 |
| 7,527,515 | B1 | 5/2009 | Olson et al. | |
| 7,549,888 | B1 * | 6/2009 | Armstrong et al. | 439/354 |
| 2005/0075001 | A1 * | 4/2005 | Shearman et al. | 439/352 |
| 2008/0132101 | A1 * | 6/2008 | Gundlach et al. | 439/266 |

* cited by examiner

*Primary Examiner* — Edwin A. Leon
(74) *Attorney, Agent, or Firm* — Nongqiang Fan

(57) ABSTRACT

A cable release accessory releases an electrical cable that is connected to an electrical device, such as a handheld moving beam reader or a handheld imaging reader for electro-optically reading symbols. The cable is terminated by a male connector that engages a female socket in the housing during reading. The male connector has a movable locking clip that releases the cable when moved. The accessory includes a holder mounted on the cable exteriorly of the device, and an elongated actuator supported by the holder and extending into the device into an overlying relationship with the locking clip. The actuator is movable against the locking clip for depressing the locking clip to release the cable.

15 Claims, 3 Drawing Sheets

ELECTRO-OPTICAL READER WITH CABLE CONNECTOR RELEASE

DESCRIPTION OF THE RELATED ART

The present invention relates to a cable accessory and, more particularly, to a cable release for releasing a cable connector that transmits power and/or data to and from electronic equipment and devices, such as handheld laser scanners or moving laser beam readers, as well as handheld solid-state imaging readers or imaging systems, both used to electro-optically read bar code symbols.

A moving laser beam reader generally includes a handheld housing, a laser for emitting a laser beam, a focusing lens assembly for focusing the laser beam to form a beam spot at a focal plane in a range of working distances relative to the housing, a scan component for repetitively scanning the beam spot across a symbol in a scan pattern, for example, a scan line or a series of scan lines, across the symbol multiple times per second, a photodetector for detecting light reflected and/or scattered from the symbol and for converting the detected light into an analog electrical signal, and signal processing circuitry including a digitizer for digitizing the analog signal and a microprocessor for decoding the digitized signal based upon a specific symbology used for the symbol.

An imaging reader generally includes a handheld housing, a solid-state imager or sensor having an array of cells or photosensors, which correspond to image elements or pixels in a field of view of the imager, an illuminating light assembly for illuminating the field of view with illumination light from an illumination light source, e.g., a laser or one or more light emitting diodes (LEDs), and an imaging lens assembly for capturing return ambient and/or illumination light scattered and/or reflected from the symbol being imaged over a range of working distances. Such an imager may include a one- or two-dimensional charge coupled device (CCD) or a complementary metal oxide semiconductor (CMOS) device and associated circuits for producing electronic signals corresponding to a one- or two-dimensional array of pixel information over the field of view. Signal processing circuitry including a microprocessor processes the electronic signals to decode the symbol. An aiming light generator may also be provided in the housing for projecting an aiming light pattern or mark on the target symbol prior to imaging.

In many readers of the type discussed above, each reader is attached to a remote host system, such as a cash register in a retail venue, by a flexible cable having multiple conductors or wires for transmission of data, such as decoded data, control data, update data, retrieved data, etc. to and from the respective reader, as well as for supplying electrical power to the electrical components in the respective reader. The cable is typically terminated with an RJ-type male locking connector that is standard in the telephone industry, such as, for example, an RJ-45 (8-wire) or an RJ-11 (4-6 wire) connector having multiple electrical contacts, and the reader supports a complementary-shaped female receptacle or socket having corresponding multiple electrical mating contacts, as disclosed in U.S. Pat. No. 3,860,316, which is incorporated herein by reference.

To maintain a secure connection and prevent the male connector from undesirably coming out of the female socket, the male connector typically includes a movable, resilient, cantilevered, plastic locking clip, which snaps and latches into place in the socket upon insertion therein, thereby resisting any axial pullout forces that may be applied to the cable. To release the connector from the socket, an operator directly depresses the locking clip to unlatch the connector, typically with a finger, thereby releasing the connector to be simultaneously withdrawn from the socket.

In a standard construction of such readers, the socket is mounted on a printed circuit board (PCB) within the interior of a handle of the reader to such an extent that the operator may not have sufficient access to directly depress the locking clip in order to release the male connector. The art has proposed inserting a thin piece of wire, typically, an end of a paper clip, or a similarly shaped tool, into a hole in the housing to reach more deeply inside the housing and depress the locking clip from the exterior of the housing. However, the hole provides an opening for dust, moisture and like contaminants to enter the housing and potentially damage the interior electronic components, and the separate wire or tool required to reach the locking clip inside the housing may be unavailable or lost when needed.

The art has also proposed in U.S. Pat. No. 7,527,515 making a lower portion of the housing elastically deformable and flexible so that this flexible portion can engage and unlatch the locking clip when the operator applies an inward pressing force on the flexible portion. However, the flexible portion is located on the handle in the immediate vicinity of the operator's hand, which is grasping the handle during handheld reading. The operator could inadvertently squeeze the flexible portion and disengage the male connector during reading, thereby interrupting the power supply and the data communications and, of course, discontinue reading.

Accordingly, there is a need for a reliable and effective remote release of the locking clip of the male electrical cable connector from the exterior of an electronic device such as an electro-optical reader, without requiring the operator to carry and insert a separate tool through the housing, and without requiring the operator to be extra cautious as to where he or she places his or her hands on the handle, as well as how strongly the operator grips the handle.

SUMMARY OF THE INVENTION

One feature of this invention resides, briefly stated, in a cable release accessory for releasing an electrical cable that is connected to a handheld electrical device, such as a moving laser beam reader or an imaging reader operative for electro-optically reading coded symbols, such as one- and/or two-dimensional bar code symbols. The reader includes a housing, preferably one having a handle held by an operator during the reading, and an actuatable trigger mounted on the handle for initiating the reading when actuated by the operator. The cable is terminated by a male connector having a movable cable release locking clip. The male connector is inserted into, and connected to, a female socket mounted within the housing, preferably on an internal printed circuit board (PCB), during reading.

The accessory includes a holder mounted on the cable exteriorly of the housing, and an elongated actuator supported by the holder and extending into the housing into an overlying relationship with the locking clip. Preferably, the actuator is formed as a cantilevered, resilient beam integral with the holder. To release the cable, the actuator is moved by a pressing force exerted by the operator against the locking clip to depress the locking clip and cause the male connector to disengage from the socket. The resilient actuator self-returns to its initial position once the pressing force is relieved. No longer is the operator required to carry and insert a separate tool through the housing. No longer is the operator required to be extra cautious as to where he or she places his or her hands on the handle, as well as how strongly the operator grips the handle, because the actuator is not part of the housing and is positioned on the holder on the cable and out of direct contact with the operator's hand.

In a preferred embodiment, the holder has a pair of shell portions that surround and clamp onto the cable. The shell portions are hinged for pivoting movement between an open position, and a closed position in which the shell portions clamp onto the cable. Advantageously, one of the shell portions has one or more locking projections, and the other of the shell portions has one or more recesses for receiving the projections with a locking action in the closed position.

Preferably, a cable strain relief is mounted on the cable, and the holder is mounted on the strain relief exteriorly of the housing. The strain relief has a plurality of cavities, and the holder has a plurality of protrusions received with a locking action in the cavities. This feature aids in preventing the holder from turning angularly about, or sliding along, the cable.

Another feature of this invention resides, briefly stated, in a method of releasing an electrical cable that is connected to a handheld electrical device by a connector having a movable cable release locking clip. The method is performed by mounting a holder on the cable exteriorly of the device, extending an elongated actuator on the holder into the device into an overlying relationship with the locking clip, and moving the actuator against the locking clip to depress the locking clip and release the cable.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
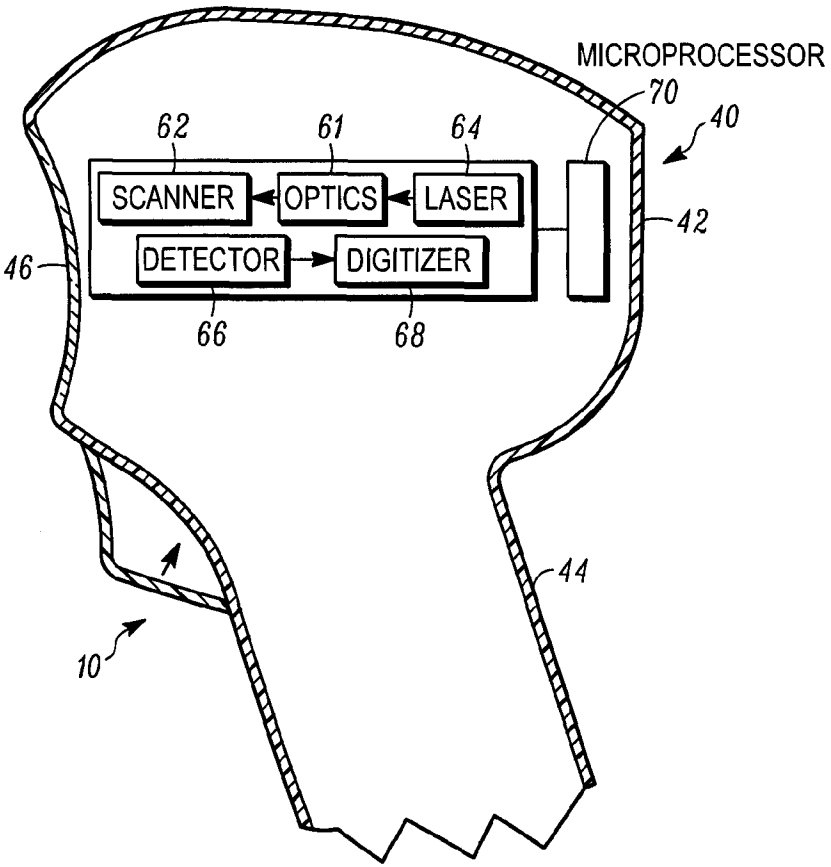
FIG. 1 is a schematic diagram of a handheld moving laser beam reader for electro-optically reading a coded symbol for use with the present invention.

FIG. 1 depicts a moving laser beam reader 40 for electro-optically reading a target such as a coded symbol, that may use, and benefit from, the present invention. The beam reader 40 includes a scanner 62 in a handheld housing 42 having a handle 44 on which a trigger 10 for initiating reading is mounted. The scanner 62 is operative for scanning an outgoing laser beam from a laser 64 and/or a field of view of a light detector or photodiode 66 in a scan pattern, typically comprised of one or more scan lines, multiple times per second, for example, one-hundred times per second, through a window 46 across the symbol for reflection or scattering therefrom as return light detected by the photodiode 66 during reading. The beam reader 40 also includes a focusing lens assembly or optics 61 for optically modifying the outgoing laser beam to have a large depth of field, and a digitizer 68 for converting an electrical analog signal generated by the detector 66 from the return light into a digital signal for subsequent decoding by a microprocessor or controller 70 into data indicative of the symbol being read.

Figure 2:
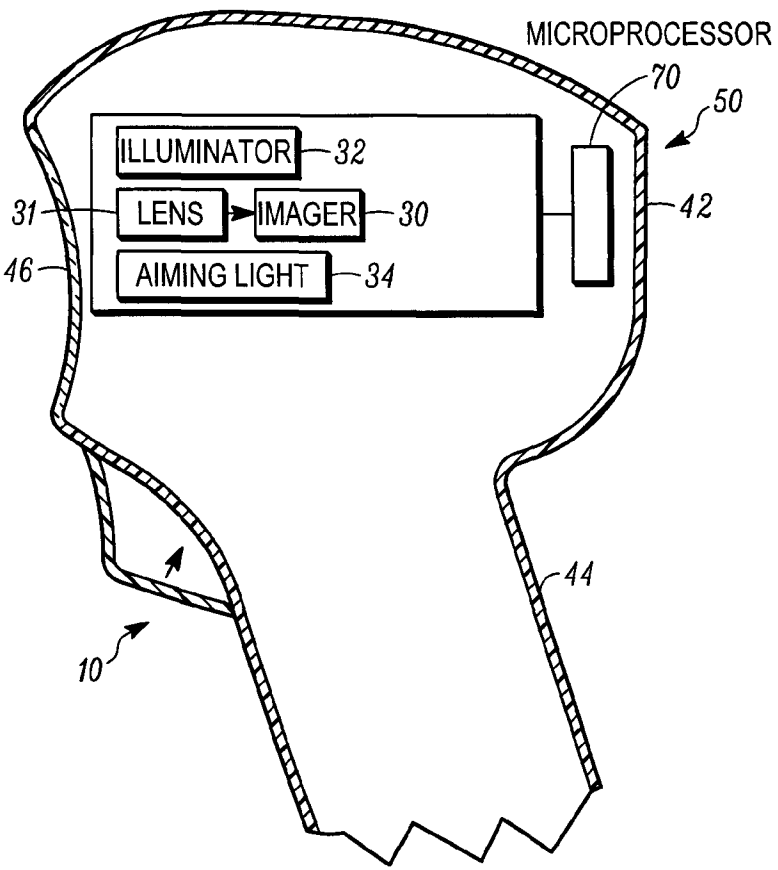
FIG. 2 is a schematic diagram of a handheld imaging reader for electro-optically reading a coded symbol for use with the present invention.

FIG. 2 depicts an imaging reader 50 for imaging targets, such as indicia or coded symbols to be electro-optically read, which may also use, and benefit from, the present invention. The imaging reader 50 includes a one- or two-dimensional, solid-state imager 30, preferably a CCD or a CMOS array, mounted in the handheld housing 42 having the handle 44 on which the trigger 10 for initiating reading is mounted. The imager 30 has an array of image sensors operative, together with an imaging lens assembly 31, for capturing return light reflected and/or scattered from the symbol through the window 46 during the imaging to produce an electrical signal indicative of a captured image for subsequent decoding by the controller 70 into data indicative of the symbol being read.

The imaging reader 50 includes an illuminator 32 for illuminating the symbol during the imaging with illumination light directed from an illumination light source through the window 46. Thus, the return light may be derived from the illumination light and/or ambient light. The illumination light source comprises one or more light emitting diodes (LEDs) or a laser. An aiming light source 34 may also be provided for emitting an aiming beam and for projecting an aiming light pattern or mark on the symbol prior to imaging.

In operation of the imaging reader 50, the controller 70 sends a command signal to drive the illuminator LEDs/laser 32, typically continuously, or sometimes periodically, during scanning, and energizes the imager 30 during an exposure time period of a frame to collect light from the symbol during a short time period, say 500 microseconds or less. A typical array needs about 33 milliseconds to read the entire target image and operates at a frame rate of about 30 frames per second. The array may have on the order of one million addressable image sensors.

Figure 4:
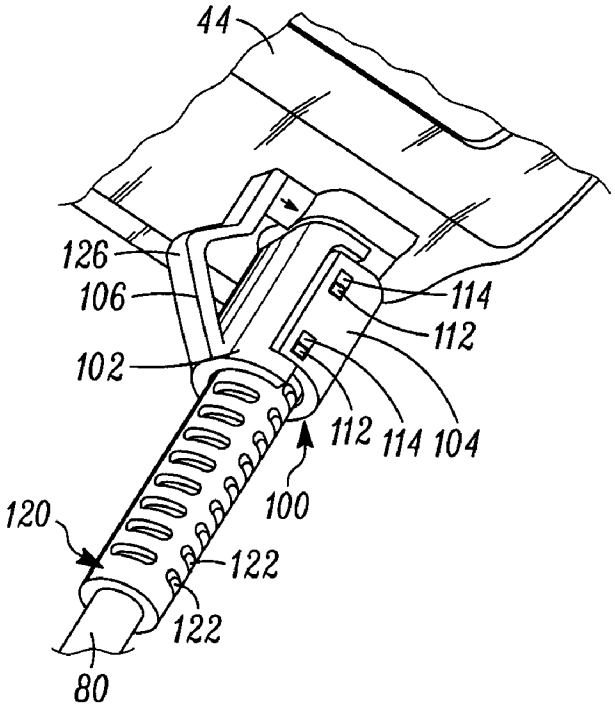
FIG. 4 is a broken-away, rear perspective view of the cable release accessory of FIG. 3.
Figure 3:
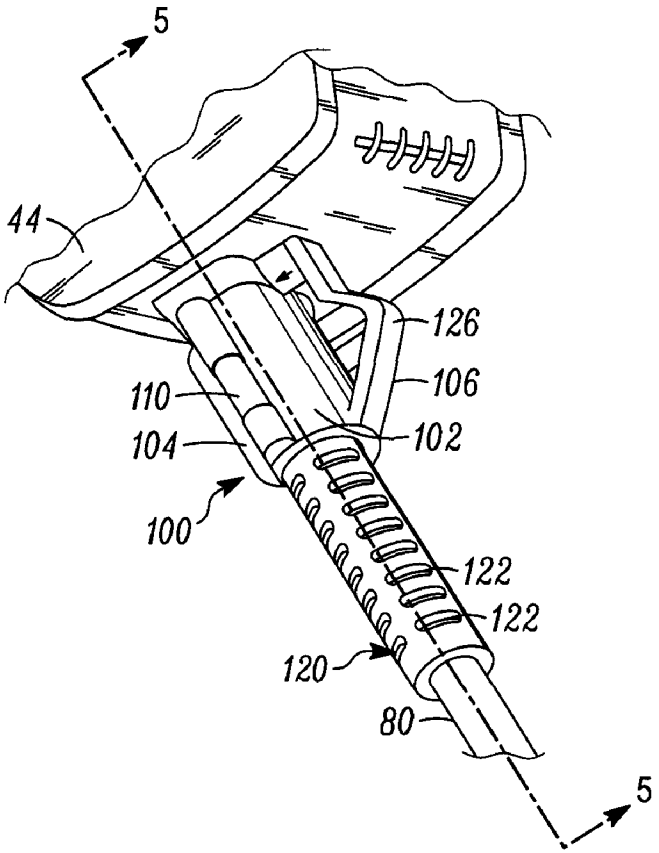
FIG. 3 is a broken-away, front perspective view of a cable release accessory in accordance with the present invention and operative for releasing an electrical cable connected to the reader of FIG. 1 or FIG. 2.
Figure 5:
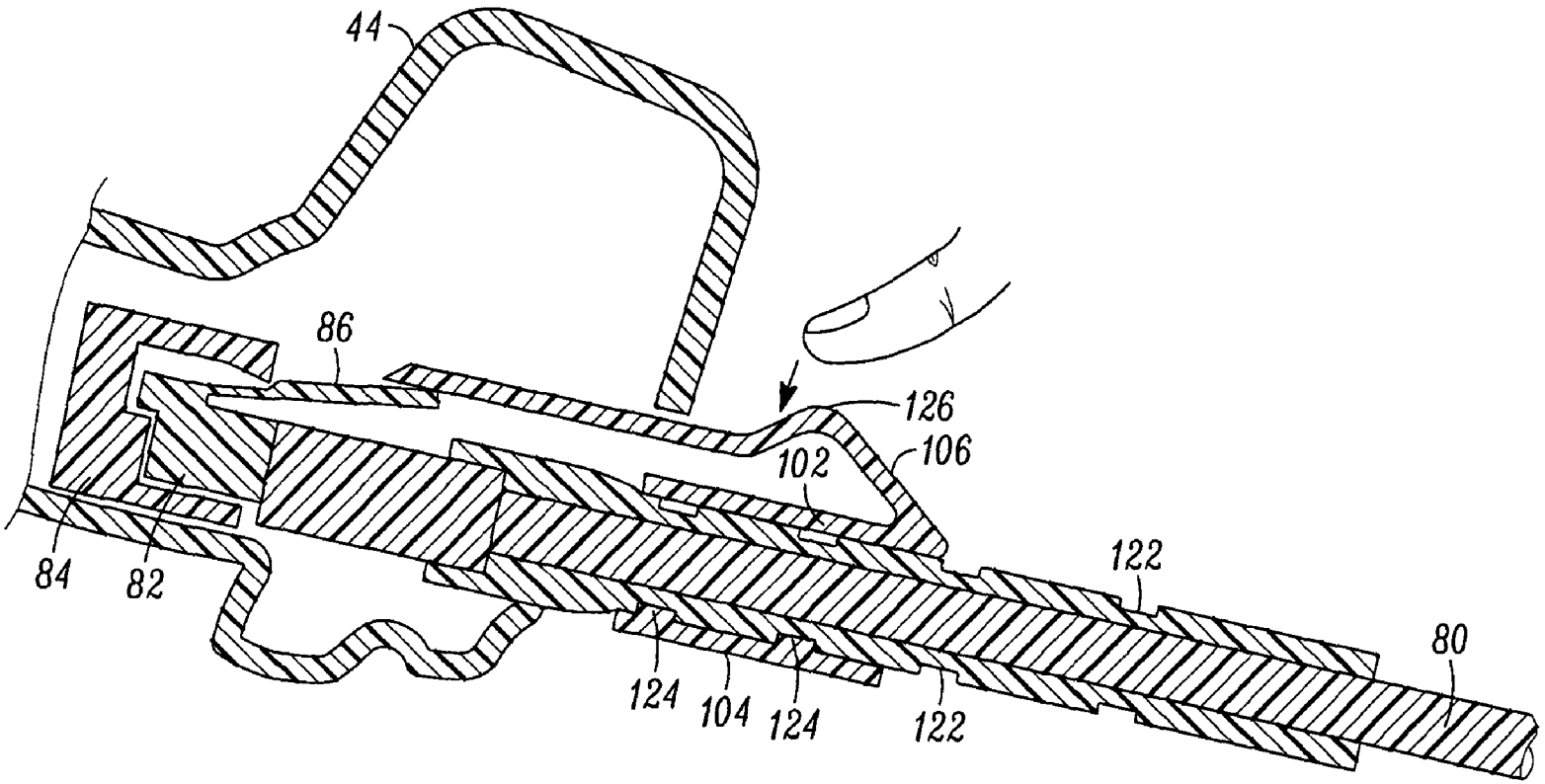
FIG. 5 is a sectional view taken on line 5-5 of FIG. 3.

As shown in FIGS. 3-4, a cable 80 is attached to a lower end region of the handle 44 of either reader 40 or 50 and connects the respective reader to a remote host system, such as a cash register in a retail venue. The cable 80 has multiple conductors or wires (not shown) for transmission of data, such as decoded data, control data, update data and retrieved data, to and from the respective reader, as well as for supplying electrical power to the electrical components in the respective reader. As shown in FIG. 5, the cable 80 is typically terminated with an RJ-type male locking connector 82 that is standard in the telephone industry, such as, for example, an RJ-45 (8-wire) or an RJ-11 (4-6 wire) connector having multiple electrical contacts, and the handle 44 of the reader supports a complementary-shaped female receptacle or socket 84 having corresponding multiple electrical mating contacts, as disclosed in U.S. Pat. No. 3,860,316, which is incorporated herein by reference. The male connector 82 has a resiliently movable, cable release locking clip 86. The female socket 84 is mounted within the handle 44, preferably on an internal printed circuit board (PCB). The locking clip 86 is resiliently deflected by the female socket 84 during insertion, and latches onto the female socket 84 upon full insertion to prevent unauthorized cable removal.

As discussed above, the socket 84 is mounted well within the interior of the handle 44 to such an extent that an operator may not have sufficient access to directly depress the locking clip 86 in order to release the male connector 82 and the cable 80. One feature of this invention resides in providing a cable release accessory 100 for releasing the cable 80. The accessory 100 includes a holder having a pair of shell portions 102, 104 that are mounted on the cable 80 exteriorly of the handle 44, and an elongated actuator 106 supported by the holder and extending into the handle 44 into an overlying relationship with the locking clip 86. Preferably, the actuator 106 is formed as a cantilevered beam integral with the holder and having a raised offset portion 126 adjacent its end farther away from the handle 44.

To release the cable 80, the actuator 106 is moved by a pressing force exerted by the operator against the offset portion 126 of the locking clip 86 to depress the locking clip 86 and cause the male connector 82 to disengage from the socket 86. The actuator 106 is resilient and, hence, self-returns to its initial position once the pressing force is relieved. No longer is the operator, as in the prior art, required to carry and insert a separate tool through the housing. No longer is the operator, as in the prior art, required to be extra cautious as to where he or she places his or her hands on the handle 44, as well as how strongly the operator grips the handle 44.

In a preferred embodiment, the shell portions 102, 104 are hinged at a hinge pin 110 for pivoting movement between an open position, and a closed position in which the shell portions surround and clamp onto the cable 80. Advantageously, one of the shell portions 102 has one or more locking projections 112, and the other of the shell portions 104 has one or more recesses 114 for receiving the projections 112 with a locking action in the closed position. The hinge pin 110 could be replaced by a living hinge. A snap-type C-shaped clip could replace the shell portion 104.

Preferably, a cable strain relief 120 is mounted on the cable 80, and the holder is mounted on the strain relief 120 exteriorly of the handle 44. The strain relief 120 has a plurality of cavities 122, and the holder has a plurality of protrusions 124 received with a locking action in the cavities 122. This feature aids in preventing the holder from turning angularly about, and sliding along, the cable 80.

It will be understood that each of the elements described above, or two or more together, also may find a useful application in other types of constructions differing from the types described above. Although the preferred embodiments have been described with reference to exemplary handheld symbol readers, it will be appreciated by those skilled in the art that the cable release feature and method described herein may be used with equal benefit for other types of electronic devices, handheld or stationary fixed mounted, that use RJ-type or equivalent electrical connectors. Accordingly, this invention is not intended to be solely limited to use only with symbol readers.

While the invention has been illustrated and described as embodied in electro-optical readers having a cable connector release feature, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. A cable release accessory for releasing an electrical cable that is connected to an electrical device by a connector having a movable cable release locking clip, comprising:

a holder mounted on the cable exteriorly of the device;

an elongated actuator supported by the holder and extending into the device into an overlying relationship with the locking clip, the actuator being movable against the locking clip for moving the locking clip to release the cable;

wherein the holder has a pair of shell portions that surround and clamp onto the cable; and wherein the shell portions are hinged at a pivotal axis for pivoting movement between an open position, and a closed position in which the shell portions clamp onto the cable, and wherein the pivotal axis extends in a direction generally parallel to the electrical cable.

2. The accessory of claim 1, wherein one of the shell portions has a locking projection, and the other of the shell portions has a recess for receiving the projection with a locking action in the closed position.

3. The accessory of claim 1, wherein the actuator is a cantilevered beam integral with the holder.

4. The accessory of claim 1, and a cable strain relief mounted on the cable, and wherein the holder is mounted on the strain relief exteriorly of the device.

5. The accessory of claim 4, wherein the strain relief has a plurality of cavities, and wherein the holder has a plurality of protrusions received with a locking action in the cavities.

6. A system for electro-optically reading symbols, comprising:

a housing;

electrical components supported by the housing for generating data corresponding to the symbols being read;

an electrical cable for connecting the housing to a remote host for supplying electrical power to the electrical components, and for transmitting the data between the reader and the host, the cable being terminated by a male connector having a movable locking clip that engages a female socket in the housing during reading;

a cable release accessory for releasing the electrical cable from the housing, the accessory including a holder mounted on the cable exteriorly of the housing, and an elongated actuator supported by the holder and extending into the housing into an overlying relationship with the locking clip, the actuator being movable against the locking clip for moving the locking clip to release the cable;

wherein the holder has a pair of shell portions that surround and clamp onto the cable; and wherein the shell portions are hinged at a pivotal axis for pivoting movement between an open position, and a closed position in which the shell portions clamp onto the cable, and wherein the pivotal axis extends in a direction generally parallel to the electrical cable.

7. The system of claim 6, wherein one of the shell portions has a locking projection, and the other of the shell portions has a recess for receiving the projection with a locking action in the closed position.

8. The system of claim 6, wherein the actuator is a cantilevered beam integral with the holder.

9. The system of claim 6, and a cable strain relief mounted on the cable, and wherein the holder is mounted on the strain relief exteriorly of the housing.

10. The system of claim 9, wherein the strain relief has a plurality of cavities, and wherein the holder has a plurality of protrusions received with a locking action in the cavities.

11. A method of releasing an electrical cable that is connected to an electrical device by a connector having a movable cable release locking clip, the method comprising the steps of:

mounting a holder on the cable exteriorly of the device;

extending an elongated actuator on the holder into the device into an overlying relationship with the locking clip;

moving the actuator against the locking clip to move the locking clip and release the cable; and wherein the mounting step is performed by moving a pair of shell portions on the holder pivotally around a pivotal axis from an open position to a closed position in which the shell portions surround and clamp onto the cable, and wherein the pivotal axis extends in a direction generally parallel to the electrical cable.

12. The method of claim 11, wherein the mounting step is performed by receiving a locking projection on one of the shell portions with a locking action in a recess on the other of the shell portions in the closed position.

13. The method of claim 11, and configuring the actuator as a cantilevered beam integral with the holder.

14. The method of claim 11, and placing a cable strain relief on the cable, and wherein the mounting step is performed by mounting the holder on the strain relief exteriorly of the device.

15. The method of claim 14, and forming the strain relief with a plurality of cavities, and wherein the mounting step is performed by forming the holder with a plurality of protrusions received with a locking action in the cavities.

* * * * *